United States Patent [19]

Kelly

[11] Patent Number: 4,665,849

[45] Date of Patent: May 19, 1987

[54] MANUFACTURE OF CASINGS FOR QUILTED ARTICLES

[75] Inventor: Brian Kelly, Rochdale, England

[73] Assignee: Isothermic Engineering & Research Limited, Douglas, Isle of Man

[21] Appl. No.: 808,513

[22] Filed: Dec. 13, 1985

[30] Foreign Application Priority Data

Dec. 15, 1984 [GB] United Kingdom ..... 8431735

[51] Int. Cl.[4] ..... D05B 25/00

[52] U.S. Cl. ..... 112/155; 112/164; 112/262.3; 112/417; 112/121.23

[58] Field of Search ..... 112/155, 164, 262.1, 112/262.3, 417, 121.23, 117, 118

[56] References Cited

U.S. PATENT DOCUMENTS

| | | | |
|---|---|---|---|
| 1,345,046 | 6/1920 | Wedlock | 112/417 |
| 1,915,329 | 6/1933 | Mitchell | 112/121.23 |
| 2,065,388 | 12/1936 | Mitchell | 112/417 X |
| 2,132,429 | 10/1938 | Mitchell | 112/121.23 |
| 2,184,808 | 12/1939 | Belian | 112/417 X |
| 3,544,417 | 12/1970 | Corzine | 112/417 X |
| 4,125,079 | 11/1978 | Black | 112/155 X |
| 4,549,494 | 10/1985 | Murphy | 112/417 X |

FOREIGN PATENT DOCUMENTS

| | | | |
|---|---|---|---|
| 2901139 | 12/1979 | Fed. Rep. of Germany | 112/155 |

*Primary Examiner*—H. Hampton Hunter

*Attorney, Agent, or Firm*—John S. Hale

[57] ABSTRACT

Sewing heads (40,41) of a sewing apparatus for sewing casings for quilts are arranged in two horizontal parallel rows which are perpendicular to the stitching direction. For forming zig-zag partitions (FIG. 2) the heads (40) of the upper row are staggered with respect to those (41) of the lower row. Pleats (42) formed in the upper facing (30) are guided together with the upper edges of a pair of divider strips (32) into the stitching zones of the upper heads (40) and pleats (43) of the lower facing (31) are guided with the lower edges of two divider strips (32) of adjoining pairs into stitching zones of the lower heads (41). For forming transverse partitions (FIG. 9), a single row of sewing heads, each having two stitching zones, may be used, a separate divider strip (332) being fed to each sewing head.

9 Claims, 14 Drawing Figures

MANUFACTURE OF CASINGS FOR QUILTED ARTICLES

DESCRIPTION

This invention relates to the production of casings for forming into quilted articles.

It is well known to form a continental quilt, duvet or sleeping bag from two pieces of fabric (facing) interconnected at intervals to provide quilting pockets which serve to prevent the insulating filling of the quilt from collecting into a single region and thereby reducing the overall efficiency of the quilt.

Initially, the two facings were interconnected merely by lines of stitching but this produces "cold spots" along the stitched seams where the insulating lining cannot pad out.

Therefore, the two facings in known quilts are now generally interconnected in another manner by providing internal dividing walls formed from strips of fabric each stitched along one edge to one facing and along the other edge to the other facing. Hitherto, these walls have been sewn to the facings by stitching each individual seam, one at a time, using a manually controlled sewing machine. However, this is a lengthy and consequently costly process.

In U.S. Pat. No. 4,125,079, dated Nov. 14, 1978 there is described apparatus for producing a casing for forming into a quilted article, comprising means for forming a plurality of pairs of corresponding folds in two facings, guides arranged to co-operate with a feed device for feeding each pair of folds side by side and simultaneously to a respective sewing station, and sewing instrumentalities adapted to secure the edges of a respective dividing strip simultaneously to the folded edges of the respective pair of folds at each station.

This prior apparatus does enable the production rate to be increased because the seams are sewn simultaneously and the materials can be fed automatically. However, the idea behind this apparatus does not enable other types of quilting to be produced, e.g. casings in which internal divider walls are arranged in zig-zag fashion between the two facings. Moreover, such apparatus occupies a large amount of floor space, since the sewing heads at the individual sewing stations are spaced apart longitudinally in the direction of advance of the facings.

The present invention resides in sewing apparatus for sewing casings for forming into quilted articles comprising a plurality of sewing heads supported so that they are arranged in at least one row extending transversely to the stitching direction and means for introducing two facings to the sewing heads from opposite sides of said row or rows and for pleating the facings, said introducing means including guide means for guiding the pleats into the stitching zones of the sewing heads, whereby the pleats are sewn to one another or to edges of divider strips also introduced to the sewing heads.

Such sewing apparatus is distinguished from that of U.S. Pat. No. 4,125,079 in that the row of sewing heads extends in a direction transverse to and preferably perpendicular to the stitching direction, whereas, in the apparatus of the prior patent, they are spaced apart in the direction of sewing so that the seams are, as it were, formed in echelon.

If the "cold spots" along a line of stitching are acceptable, a single row of sewing heads suffices and the pleats are sewn to one another, the divider strips being thus dispensed with. This enables a casing to be produced which appears blind-stitched from both side, a product which prior sewing apparatus is not capable of producing.

A single row of sewing heads also suffices if each sewing head is, in effect, a double head adapted to form two spaced apart seams, as shown in U.S. Pat. No. 4,125,079, and a divider strip is introduced to each double head. Such apparatus then manufactures the same product as that of the prior British Patent.

Alternatively, the sewing heads are arranged in tow rows with the heads in registry with one another to form pairs, a divider strip being fed to each pair of sewing heads.

In a preferred embodiment, however, the sewing heads are arranged in two rows with the heads in one row staggered with respect to those in the other row and divider strips are introduced between the two rows such that the two edges of each strip are guided, one into the stitching zone of a sewing head of one row and the other into that of a sewing head of the other row, so that each sewing head sews edges of two divider strips to one pleat, whereby the divider strips become arranged in zig-zag fashion between the two facings.

It has not been possible to manufacture such casings on prior sewing apparatus, other than by using a simple sewing machine to sew one seam at a time.

It will be appreciated that the sewing heads are supported wholly inside the casing being sewn so that both sides appear to be blind stitched.

Preferably the sewing heads are arranged in one or two horizontal rows with the stitching direction also substantially horizontal and perpendicular to the row or rows.

The invention includes a sewing apparatus for sewing casings for forming into quilted articles comprising a plurality of sewing heads supported in two parallel rows with the heads in one row staggered with respect to the heads in the other row, means for introducing two facings to the sewing heads from the opposite sides of said rows and for pleating the facings as they are introduced with the pleats of each facing entering the stitching zones of the sewing heads of the row adjacent such facing, and means for introducing divider strips into a gap between the rows of sewing heads and for guiding each divider strip so that the opposite longitudinal edges thereof go to stitching zones of two respective sewing heads, one in each of the two rows, such that one facing pleat and one edge of each of two divider strips are presented to each stitching zone.

The present invention also includes a method of making a casing for forming into quilted articles, in which two facings are fed with divider strips therebetween to a seam forming station at which longitudinal seams are formed simultaneously, each seam comprising adjoining longitudinal edges of two adjacent divider strips and an inward pleat in a respective facing, the seams in one facing being staggered with respect to the seams in the other facing, whereby the divider walls formed by the divider strips are arranged in zig-zag fashion between the two facings.

Although the invention is particularly applicable to the stitching of casings for continental quilts, it will be understood that it might have other applications, such as in forming other quilted articles containing elongate pockets.

A sewing head in accordance with this invention comprises first and second arms adapted to be fixedly mounted at a proximal end and extending generally parallel to one another to define a stitching zone between their distal ends, a needle being reciprocably mounted at the distal end of the first arm for movement transversely thereto through the stitching zone and through a hole plate at the distal end of the second arm and a looper arranged in the distal end of the second arm behind the hole plate so as to co-operate with the needle thread, a needle drive shaft and a looper drive shaft being mounted in the first and second arms, respectively, so as to extned through the length thereof. The needle and looper drive motions are thereby transmitted from the proximal or mounting ends of the arms.

Because of the restricted space at the distal or free ends of the arms, it is advantageous for the needle to be attached to a needle block which is slidably mounted in the first arm and for the needle drive shaft to be rotatable, preferably angularly reciprocable, and to be coupled to the needle block by means of a crank arm.

The looper can be directly mounted on the looper drive shaft which is then angularly reciprocable. To obtain the needle avoiding movement of the looper, the looper drive shaft is preferably also axially displaceable.

The thread take up device for the needle thread and that for the looper thread, if present, is preferably mounted adjacent the fixed ends of the arms, i.e. remotely from the sewing instrumentalities.

In the preferred embodiment, feed dogs are absent and, instead, a take-up roll for the sewn casing is rotated in timed relationship to the needle movement to draw the facings and the dividing strip, when present, through the stitching zone. A simple, spring loaded presser foot presses the facings, etc. against the hole plate.

The invention is further described, by way of example, with reference to the accompanying drawings, in which.

Figure 1:
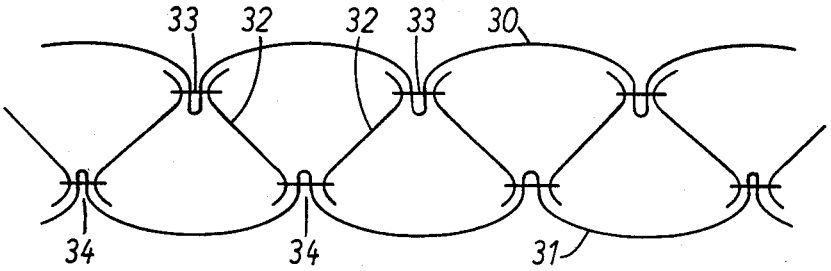
FIG. 1 is a sectional view of a quilt having a casing made in the apparatus of FIGS. 2 to 8.

FIG. 1 shows a quilt in diagrammatic cross-section. It comprises outer layers or facings 30,31, interconnected by dividing walls or divider strips 32, which are arranged in zig-zag fashion and divide up the interior of the quilt to reduce the likelihood of the quilt stuffing or filling from migrating and thereby becoming uneven. It can be seen that two edges of two adjoining divider strips 32 are sewn to the facing 30 at seams 33 and the opposite edges of the divider strips 32 are sewn to the other facing 31 at seams 34. The seams are stitched from the inside so that they appear to be blind stitched in the finished quilt.

Figure 2:
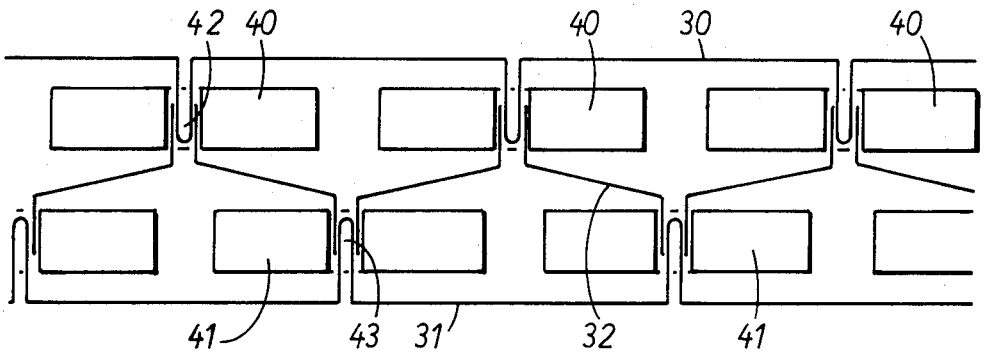
FIG. 2 is a diagrammatic sectional elevation of a part of sewing apparatus in accordance with a preferred embodiment of the invention.

FIG. 2 is a diagrammatic view of the sewing heads of sewing apparatus for stitching the casing of the quilt shown in FIG. 1. Sewing heads 40 are arranged in an upper row and sewing heads 41 are arranged in a lower row closely spaced from the upper row but staggered relative thereto. The facings 30 and 31 are introduced to the upper heads 40 and lower heads 41 respectively from opposite sides of the rows of heads, folds or pleats being formed in the facings before they reach the sewing heads. The pleats 42 in the upper facings are guided into the stitching zones of the sewing heads 40 and the pleats 43 in the lower facing 31 are guided into the stitching zones of the sewing heads 41. The divider strips 32 are introduced into the narrow gap between the upper and lower rows of sewing heads 40 and 41 and one edge of each divider strip 32 is guided into the stitching zones of the upper heads 40 and the other edges are guided into the stitching zones of the lower heads 41. The upper sewing heads 40 sew one edge of two adjoining divider strips 32 to each pleat 42 to form the seams 33 and the other edges of the divider strips 32 are sewn by the sewing heads 41 to the pleats 43 of the lower facing 31. Whilst the pleats 42 are shown as being introduced between the edges of the two divider strips 32, the guides (not shown) may be such that the two edges of the divider strips are sewn together and to one side of the pleat 42. Whilst in this case the divider strips would not lie exactly as shown in FIG. 1, the outer appearance of the casing would be identical.

Figure 3:
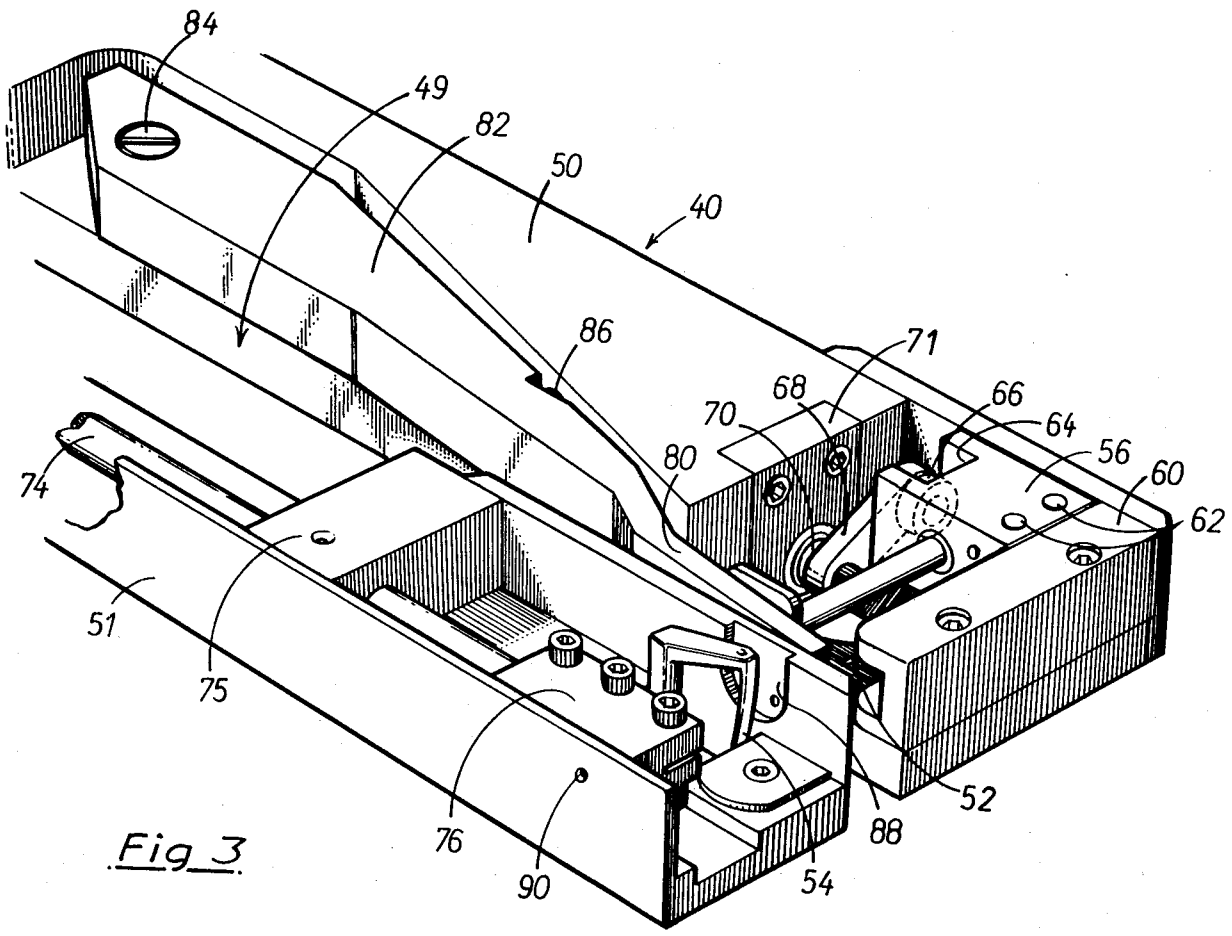
FIG. 3 is a perspective view of the free end of a sewing head in accordance with the invention, showing the fabrics being sewn.

FIG. 3 is a detailed view of the stitching zone of one of the sewing heads 40. The sewing head comprises two horizontal and generally parallel arms 50 and 51, between which is formed a space 49. The stitching zone proper is the gap between the free front or distal ends of the arms 50 and 51. The sewing instrumentalities comprise a needle 52 slidably mounted in the arm 50 and a looper 54 angularly displaceably mounted in the arm 51.

FIG. 3 shows the needle 52 retracted so that only its point is visible. Because of the lack of available space for moving parts, the needle 52 is not attached to a needle bar; instead it is detachably secured to a needle block 56 which is slidably mounted on a short rod 58 fixed to the forward end of the arm 50 and extending horizontally and perpendicular to the stitching direction, this being the forward direction in FIG. 3, i.e. frontwards and rightwards in this Figure. A brass block 60 secured to the forward extremity of the arm 50 prevents the needle block 56 from turning about the rod 58. Holes 62 in the needle block 56 receive small grub screws by which the needle 52 is secured to the block 56.

A crank arm 68 on a forward end of a needle drive shaft 70 carries a roller 66 which is received in a vertical groove 64 in the rear of the needle block 56. Thereby the needle block and the needle are caused to reciprocate by angular oscillations of the needle drive shaft 70.

The needle drive shaft 70 extends throughout the full length of the arm 50 as will be hereinafter described more fully.

The looper 54 is attached to a looper drive shaft 74 by means of a clamp 76. The angular displacement of the looper is achieved by rocking the looper drive shaft 74 back and forth and the needle avoid movement of the looper is produced by small axial displacements of the looper drive shaft 74 as will be described more fully hereinafter.

A presser foot 80 is formed on the forward end of a presser arm 82 which is pivoted to the arm 50 at a bearing 84. A spring 86 urges the presser foot 80 against a hole plate 88 attached to the forward end of the arm 51. The needle hole in the hole plate is visible in FIG. 3.

Also shown in FIG. 3 is a thread hole 90 at the outside of the arm 51 for the looper thread. The looper thread is fed from the rear as will be described hereinafter and passes through the hole 90 to the looper. Also shown in FIG. 3 is the usual hole at the rear of the looper hook. The looper is entirely conventional and has a thread groove on its inner face and a further hole for the thread at the tip of the looper. Similarly there is a thread hole (not visible in FIG. 3) in the outside of the arm 50 opposite to the hole 90 and this unseen hole is aligned with a thread hole 92 in the needle block 56. The needle thread is fed from the rear of the head 40 and passes through the unseen hole and then through the hole 92 to the eye of the needle 52.

It will be noticed that feed dogs are entirely absent from the sewing head 40. The casing being sewn is drawn through the sewing heads by means of nip rolls as will be described hereinafter. Also absent from the sewing head 40 are the thread take-up devices. Because of shortages of space these are arranged adjacent the rear ends of the heads 40 as will be described hereinafter. The actual stitch formation will not be described as this is entirely conventional. The stitch is called a two thread chain stitch or a double locked stitch and is also denoted as stitch type 401.

The looper drive shaft 74 is shown supported at its forward end in a bearing block 75 provided with a lubrication hole and the needle drive shaft 70 is supported at its forward end in a bearing block 71. The rearward ends of the shaft are similarly supported.

Figure 5:
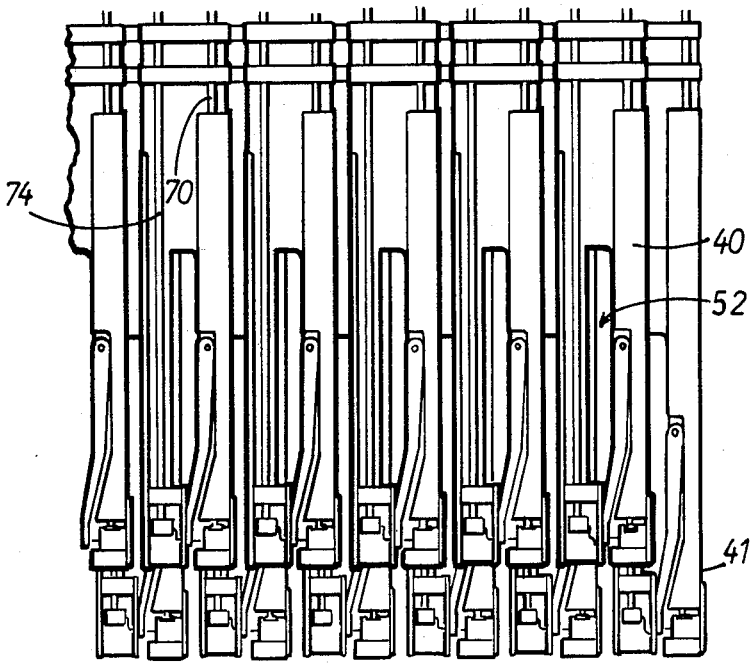
FIG. 5 is a plan view of part of the array of sewing heads.
Figure 6:
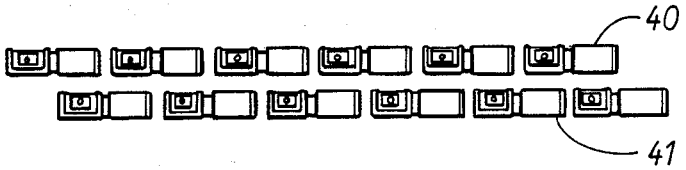
FIG. 6 is a front end elevation of the array of sewing heads.
Figure 4:
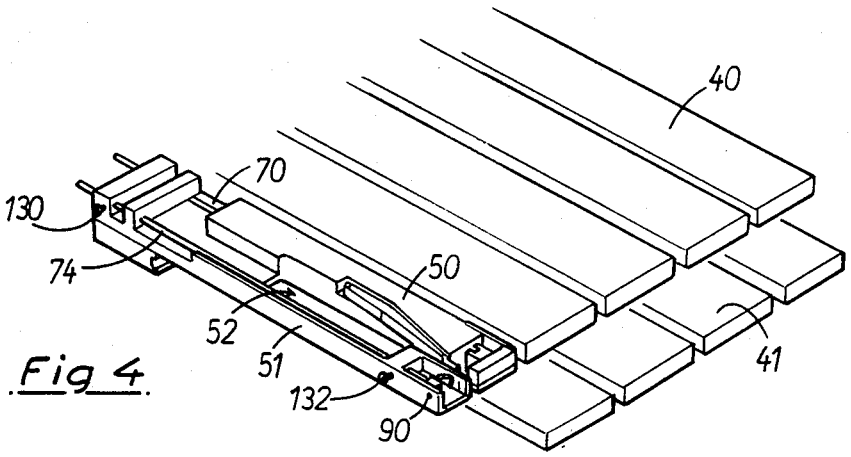
FIG. 4 is a perspective view showing part of an array of the sewing heads arranged in two staggered and offset rows.

FIGS. 4, 5 and 6 are somewhat diagrammatic views to show how the upper heads 40 are staggered with respect to the lower heads 41 and are at the same time offset rearwardly so as to enable access to the sewing instrumentalities of the lower heads without the need to remove the upper heads. This is essential for threading purposes and also general servicing and adjustment. The needle drive shaft 70 and the looper drive shaft 74 are clearly shown in FIGS. 4 and 5. For clarity the drive shafts are shown with their rear drive pulleys removed.

FIGS. 4 and 5 also show that the arms 50 and 51 are integral with one another at their proximal or rear mounting ends.

Figure 7:
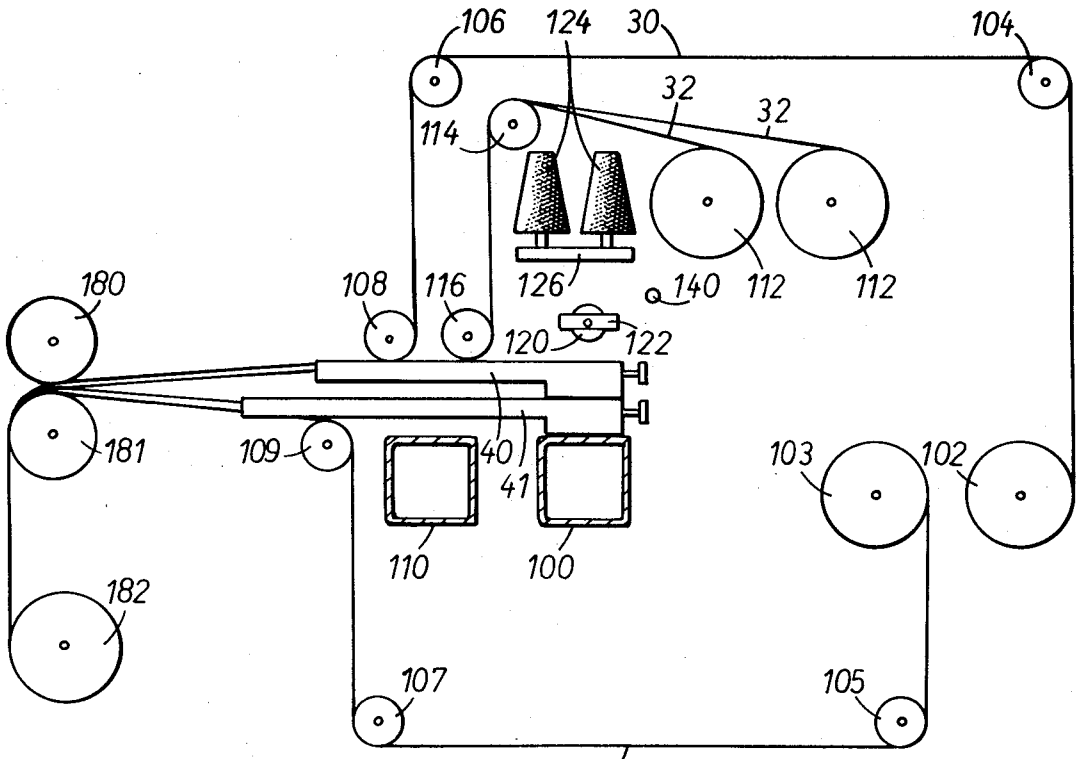
FIG. 7 is a diagrammatic sectional view of the apparatus with most parts of its frame omitted.

FIG. 7 is a highly diagrammatic view from which most parts of the frame of the apparatus have been omitted. This view is primarily for the purpose of showing the locations of various parts hitherto not described. The frame includes a horizontal beam 100 to which the rear ends of the lower heads 41 are attached. The rear ends of the upper heads 40 are attached to the rear ends of the heads 41. The upper facing 30 is fed from a supply reel 102 over guide rolls 104 and 106 to a roll 108 which extends horizontally above the upper row of heads 40 and close thereto but somewhat behind the stitching zones. Similarly the facing 32 is fed from a supply reel 103 and under guide rolls 105 and 107 to a roll 109 which extends below the lower row of sewing heads 41 but closely adjacent thereto and rearwardly of their sewing zones. Between the supply reel 102 and the guide roll 108 there is a pleating device (not shown) which comprises guide fingers and which serves to form the above-mentioned pleats in the facing 30. These pleats are flattened out as they pass over the guide rolls and in particular are still flattened when they pass over the guide roll 108. Guide fingers (not shown) lower the pleats into the stitching zones of the upper heads 40. Similarly, a pleating device is arranged between the reel 103 and the lower guide roll 109 for pleating the facing 31 and guide fingers (not shown) lift the pleats and introduce them into the stitching zones of the lower sewing heads 41. The frame includes a beam 110 which serves to support the various guides (not shown), this beam being forward of the beam 100.

The divider strips 32 are fed from a plurality of supply reels 112 which need to be arranged in two rows since the combined width of the divider strips is greater than the width of the pleated facings 30 and 31. The divider strips 32 pass over a guide roll 114 to a roll 116 which extends above the upper row of sewing heads 40 and behind the guide roll 108. The divider strips 32 are gathered by means (not shown) before they reach the guide roll 116 so that the divider strips can be introduced, two through each of the openings 49 to the above-mentioned narrow gap between the upper and lower row of sewing heads. Alternatively, the divider strips could be guided through the spaces between adjacent upper sewing heads 40. Further guide fingers (not shown) supported on the beam 110 then open out the divider strips and guide their opposite edges to the stitching zones of the upper and lower rows of sewing heads 40 and 41 respectively to enable the seams to be formed as shown in FIG. 2.

The thread take-up devices comprise cams 120 which protrude through a plate 122 fixed to the apparatus frame. Each thread take-up device is conventional inasmuch as it comprises a cam 120 across whose edge the respective thread passes, guide eyes for the thread being attachee to or formed in the plate 122. As the cam 120 is rotated, the thread is thereby taken up and let out as with a conventional thread take-up device. There is one cam for each thread, i.e. two cams for each sewing head. All of the cams 120 are arranged on a common shaft which extends parallel to the rows of heads 40 adjacent the rearward ends thereof.

The threads are fed from spools 124 mounted on a beam 126 which extends well above the beams 100 and 110 but below the upper facing 30 and the divider strips 32 being drawn from the reels 102 and 112. The thread from one of the spools 124 passes through a respective guide eye of the beam 126 and then down to a respective guide eye on the plate 122. It then passes over the edge of the respective cam 120 and to the other guide eye on the plate 122. The thread continues to a guide eye 130 on one side of the proximal end of one side of the respective sewing head 40, such a sewing eye 130 being shown in FIG. 4. The thread is then led forwardly to a sewing eye 132 on the forward end of the arm 51, from where the thread passes to the thread eye 90. This thread is FIG. 4 is a looper thread. The needle thread is guided from the respective guide eye on the plate 122 to guide eyes on the other side of the sewing head 40 which guide eyes are concealed in FIG. 4 but lie opposite the guide eyes 130 and 132. Additional guides are required for the looper and needle threads for the lower heads 41 because these are staggered relative to the heads 40. Thread guide tubes may extend the length of the sewing head in place of the guide eyes 130 and 132.

Figure 8:
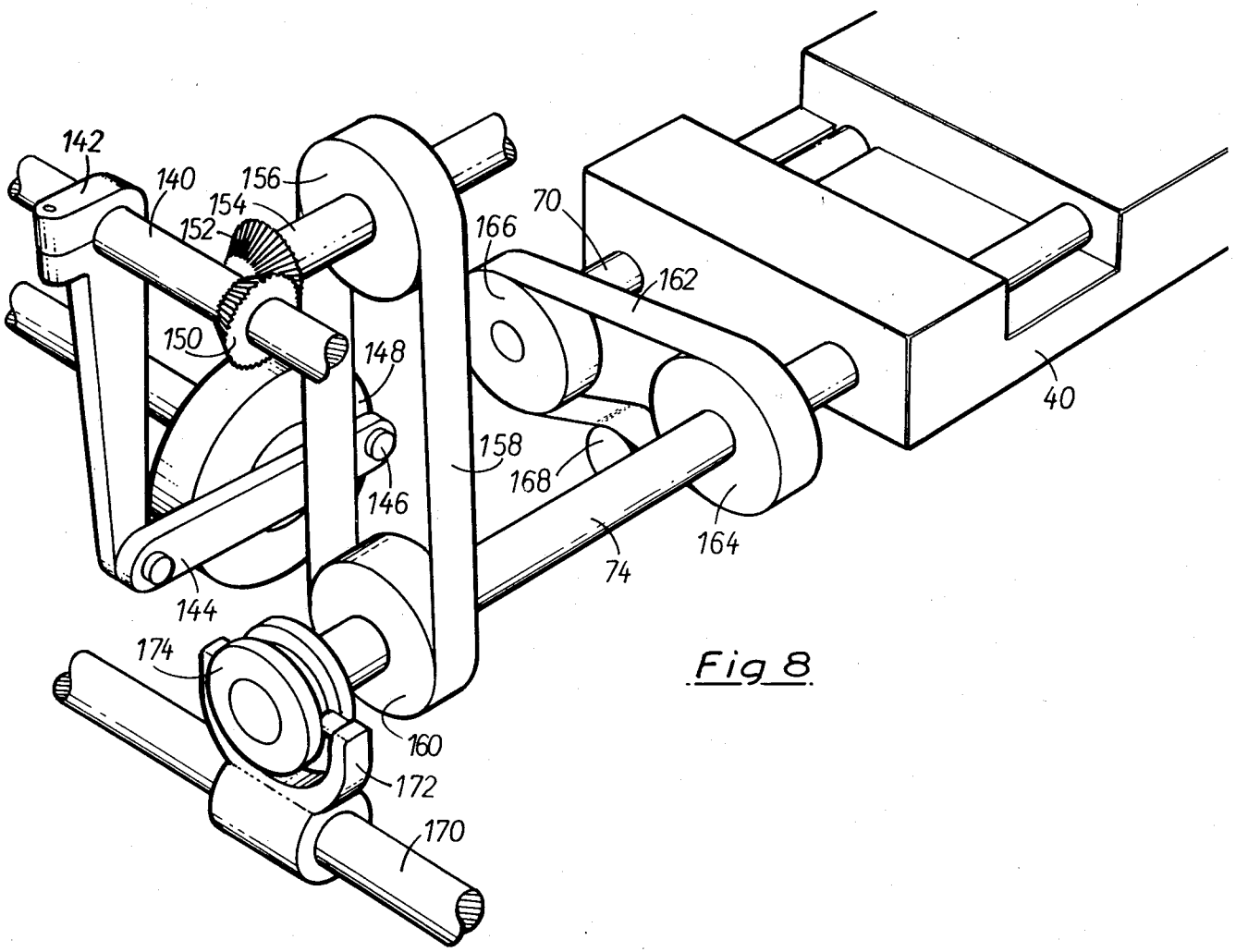
FIG. 8 is a digrammatic detail view showing the needle and looper drives for one sewing head.

FIG. 8 is a highly diagrammatic view of the needle and looper drives for a sewing head 40. This drive comprises a timing shaft 140 which extends throughout the width of the apparatus and is common to all of the sewing heads. The location of the timing shaft 140 is shown diagrammatically in FIG. 7 from where it can be seen that it lies above and to the rear of the rows of sewing heads 40 and 41. The timing shaft 140 is caused to oscillate back and forth and for this purpose it has on one end a crank arm 142 coupled by a connecting link 144 to a pivot 146 on a drive wheel 148. The drive wheel 148 is caused to rotate continuously.

An individual bevel gear 150 on the timing shaft 140 meshes with a bevel gear 152 on an input shaft 154. The input shaft 154 carries a pulley 156 and a toothed belt 158 passes over this pulley 156 and a pulley 160 on the rear end of the looper drive shaft 74 of the respective sewing head 40. The looper drive shaft 74 is thus caused to oscillate back and forth by virtue of the rotation of the drive wheel 148. The oscillating motion of the needle drive shaft 70 is derived from that of the looper drive shaft 74 by means of a toothed belt 162 entrained about pulleys 164 and 166 on the looped and needle drive shafts respectively. An idler pulley 168 keeps the belt 162 taut and a similar idler pulley can be provided for keeping the drive belt 158 taut. The pulley 166 is smaller than the pulley 164 whereby the amplitude of angular movement of the needle drive shaft 70 is greater than that of the looper drive shaft 74. This is necessary in order to obtain the desired relative travels of the needle and the looper.

The looper avoid motion is obtained from a separate timing shaft 170 which is arranged below the timing shaft 140. A separate crank drive or cam drive (not shown) is provided for the timing shaft 170 for driving the latter in synchronism with but out of phase with the timing shaft 140. A fork 172 is attached to the common timing shaft 170 and engages a peripheral annular groove in a collar 174 attached to the rear end of the looper drive shaft 74. The needle avoid movement is very small and the corresponding axial displacements of the looper drive shaft 74 are tolerated by the toothed belts 158 and 162.

A separate input shaft 154 with its associated bevel gears 150 and 152 can be provided for each sewing head 40 and 41 or, alternatively, can be common to one upper and one lower sewing head. In the latter event the input shaft 154 would carry two pulleys 156. However, separate timing shafts 170 are provided for the upper and lower rows of sewing heads because these timing shafts must lie close to the axes of the respective looper drive shafts 74. The thread take-up cams 120 (FIG. 7) rotated in synchronism with rotation of the drive wheel 148.

FIG. 7 shows the co-operating pinch rolls 180 and 181 which serve to draw the casing through the sewing apparatus and operate in place of the conventional feed dogs. The pinch rolls 180 and 181 must therefore be driven with an intermittant motion but in synchronism with the angular displacements of the timing shafts 140 and 170. This intermittent drive may, for example, be achieved by means of a ratchet mechanism driven through a crank which rotates at the same speed as the drive wheel 148. Finally the sewn casing passes to a take-up reel 182.

Because the threading of the sewing apparatus is so complex, it is anticipated that, when the supply reels 102, 103 and 112 are spent, the trailing ends of the respective facing or strip will be sewn to the leading ends on a replacement supply reel. This can be done with the apparatus temporarily stopped.

Figure 9:
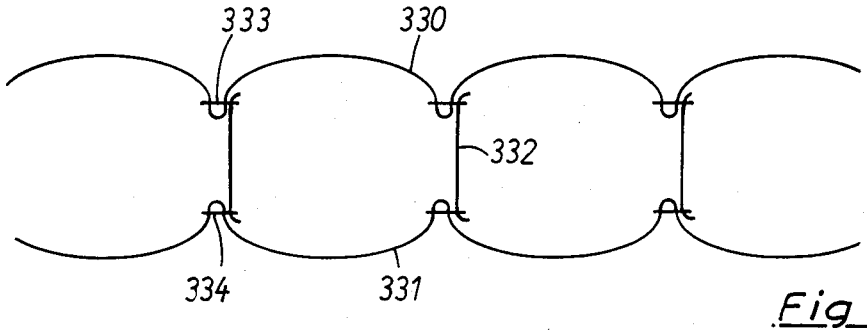
FIGS. 9 and 10 are views, similar to FIGS. 1 and 2, but relating to a second embodiment.
Figure 10:
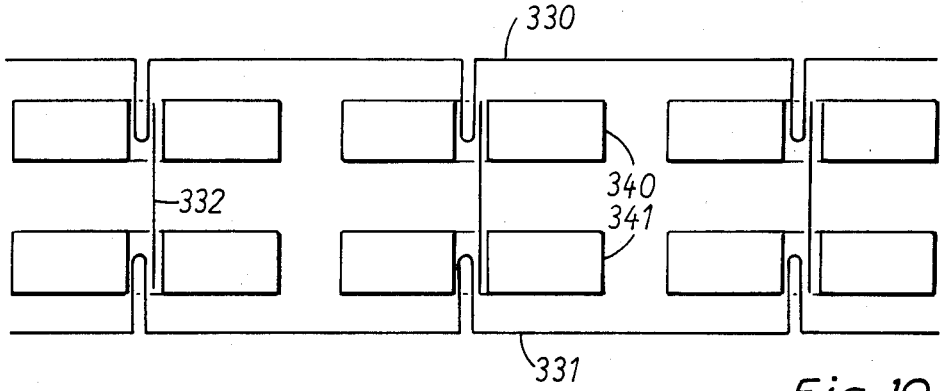

FIG. 9 shows a fragment of a quilt in which divider strips 332 extend directly between the facings 330 and 331. The seams 333 and 334 therefore lie directly in alignment with one another and the casing is thus substantially identical to that produced by the apparatus described in British Pat. No. 1,572,191. However, this casing is not produced by that prior apparatus but by the apparatus in accordance with the invention but modified as shown in FIG. 10. The sewing heads 340 and 341 are constructed and driven exactly as described with reference to the previous figures but the heads 340 in the upper row are not staggered with respect to the heads 341 in the lower row and instead are in alignment. Also the rows are spaced somewhat further apart so as to conform to the width of the divider strips 332. Fewer divider strips 332 are required since only one divider strip is sewn at each seam 333 or 334. The guide means for guiding the divider strips 332 to the stitching zones of the sewing heads will be different from that described with reference to FIG. 7 but will be similarly supported on a beam 110, as shown in FIG. 7.

Figure 11:
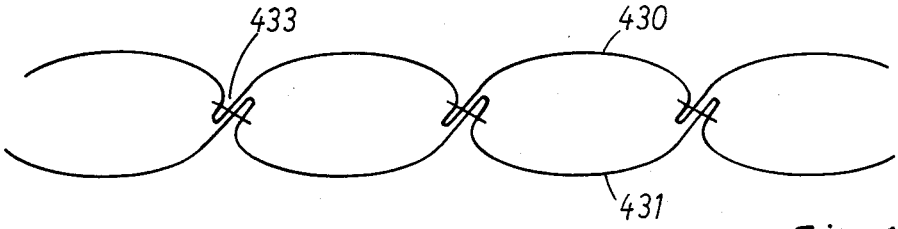
FIGS. 11 and 12 are views, similar to FIGS. 1 and 2, but relating to a third embodiment.

FIG. 11 shows a quilt in which facings 430 and 431 are directly joined together at seams 433 without the use of any divider strips. Such a quilt obviously has poorer insulating properties than the quilts of FIGS. 1 and 9 but is adequate for warmer climates. The apparatus of the invention as shown in its version of FIG. 12 can be used for producing the casing for the quilt of FIG. 11 which appears to be blind-stitched from both sides, i.e. the casing is sewn from the inside. The sewing apparatus thus comprises a single row of sewing heads 440, each of which is constructed and driven as described above with reference to FIGS. 3 to 7. One pleat 442 in the upper facing 430 is introduced into the stitching zone of the respective sewing head 440 from above and one pleat 443 in the lower facing 431 is introduced into the same stitching zone from below. The sewing heads therefore sew together these pleats adjacent their extremities so that the stitching cannot be seen from the outside of the casing.

Figure 12:
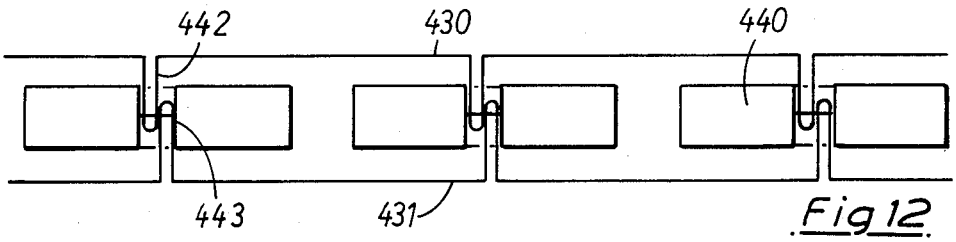

FIG. 12 shows a sewing head 540 for making casings for the quilt illustrated in FIG. 9. The sewing head 540 comprises two arms 550,551, two stitching zones being formed between the distal ends of these arms shown in FIG. 14. The arm 550 comprises a single tube 501 having a needle housing 502 on its forward end and attached by its rear end to the housing of a drive mechanism 500. The arm 551 comprises two tubes 503 and 504 which are parallel to the tube 501 and whose forward ends carry a bracket 505 to which a hole plate 588 is attached. The tubes 503 and 504 are also attached to the housing of the drive mechanism 500. Such housing is adapted to be secured to a beam like the beam 100 so that a plurality of sewing heads like the head 540 of FIGS. 13 and 14 can be supported in a row which extends transversely to the sewing direction (arrow 506 in FIG. 13).

Two needles 552 and 553 (of which the needle 553 is hardly visible), are attached respectively to an upper arm 528 and a lower arm (concealed ) of a needle block 556 which is slidably mounted on a short rod 558 fixed in the needle housing 502 so that the rod 558 extends horizontally and perpendicular to the stitching direction 506. The rear face (not shown) of a block 560 forming the front part of the needle housing 502 engages the needle block 556 to prevent the latter from turning about the rod 558. A vertical groove in the rear face of the needle block 556 is engaged by a roller on a crank arm (not shown) which is attached to the forward end of a needle drive shaft 574. Such groove, roller and crank arm are substantially the same as the groove 64, roller 66 and crank arm 68 of FIG. 3, the main difference in FIG. 14 being that the needle block 556 carries two needles which are spaced apart and act as sewing instrumentalities for two stitching zones which are spaced apart vertically.

Two loopers 554 and 555 are attached to looper drive shafts 574 and 575 by respective clamps 576 and 577. A presser foot 580 is suported on the forward end of a presser arm 582 which is pivoted to the arm 550 at a pivot 584 on the rear end of the tube 501. A small spring (not shown) acts on the presser arm 582 to bias the presser foot 580 towards the needle bed plate or hole plate 588. The latter has a rearward extension by which it is attached directly to the bracket 505 and the forward edge of the hole plate is attached to a support bracket 508 clamped to a rod 507 which projects forwardly from the bracket 505.

Thread guide tubes 509, 510 on the first arm 550 and 511,512 on the second arm 551 guide the threads (not shown) from thread tensioners 513,514,515 and 516 on the drive mechanism 500 to the needles 552, 553 and loopers 554,555, respectively. Thread take-up springs 517, 519 for the looper threads are provided on the housing of the drive mechanism 500 so as to engage the looper threads (not shown) between the respective tensioner and looper. Thread take-up for the needle threads is accommodated in the needle housing 502. To this end, the needle threads (not shown) from the tubes 509,510 pass respectively under and over an L-shaped arm 524 and respectively to an upper eye 526 on the upper arm 528 of the needle block 556 and a lower eye (concealed) of the lower (concealed) arm. The needle threads then lead from the upper eye 526 and the lower (concealed) eye to the needle eyes. The loopers 554, 555 receive the looper threads in a conventional fashion.

The drive mechanism 500 has at its rear an input shaft 521 on which is mounted an input bevel gear 522. All of the input shafts 521 of all the sewing heads 540 in the row are driven in synchronism from a common timing shaft (not shown) which extends along the row like the timing shaft 140 of FIG. 8, such timing shaft having a respective bevel gear in mesh with the bevel gear 522 of each sewing head 540.

Unlike the timing shaft 140, that (not shown) for the sewing head 540 is rotated continuously in one direction. The drive mechanism 500 derives from the consequent continuous rotation of the input shaft 521, an oscillating rotary motion for the needle drive shaft 570 an oscillating rotary motion for the looper drive shafts 574,575 and a looper avoid motion for the latter shafts. The drive mechanism 500 contains suitable gear trains and cam drives for driving all of these motions. Such cam drives and gear trains are conventional in sewing machines for producing stitch type 401 mentioned previously and are therefore not described.

If the common timing shaft (not shown) were to be oscillated back and forth like the timing shaft 140 of FIG. 8, then a second timing shaft, like the shaft 170, would be required to generate the looper avoid motion since the latter is out of phase with the needle reciprocation.

Feed dogs are absent from the sewing head 540 and the intermittent feed motion is applied to the sewn casing by pinch rolls which, like the pinch rolls 180,181 of FIG. 7, are rotated in stepwise fashion in synchronism with rotation of the timing shaft. The general arrangement of the thread supports, facing supplies and guides and divider strip supplies and guides for sewing apparatus comprising a row of sewing heads 540 is similar to that shown in FIG. 7. The single separate divider strip is fed to each sewing head 540 and is guided to the stitching zone by a flattened arcuate guide tube 524 (FIG. 13), which replaces the guide roll 116 of FIG. 7.

Figure 13:
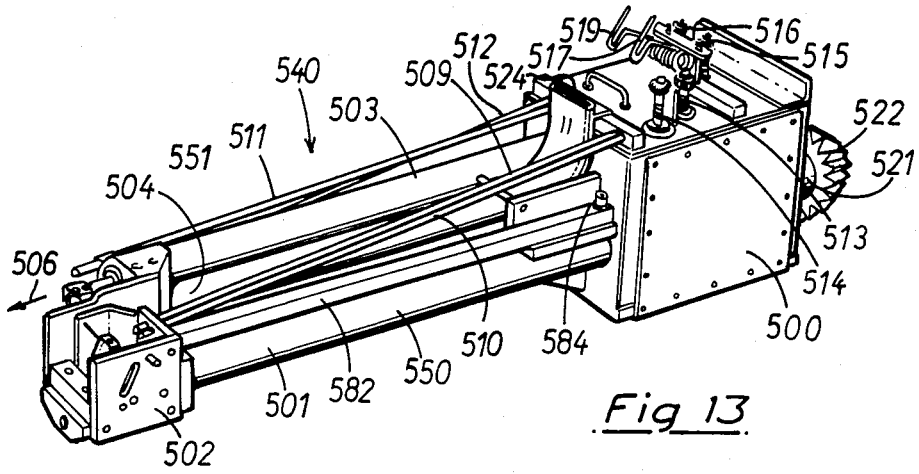
FIG. 13 is a perspective view of another embodiment of sewing head, designed to be used in the apparatus of FIG. 10 for making the quilt of FIG. 9.
Figure 14:
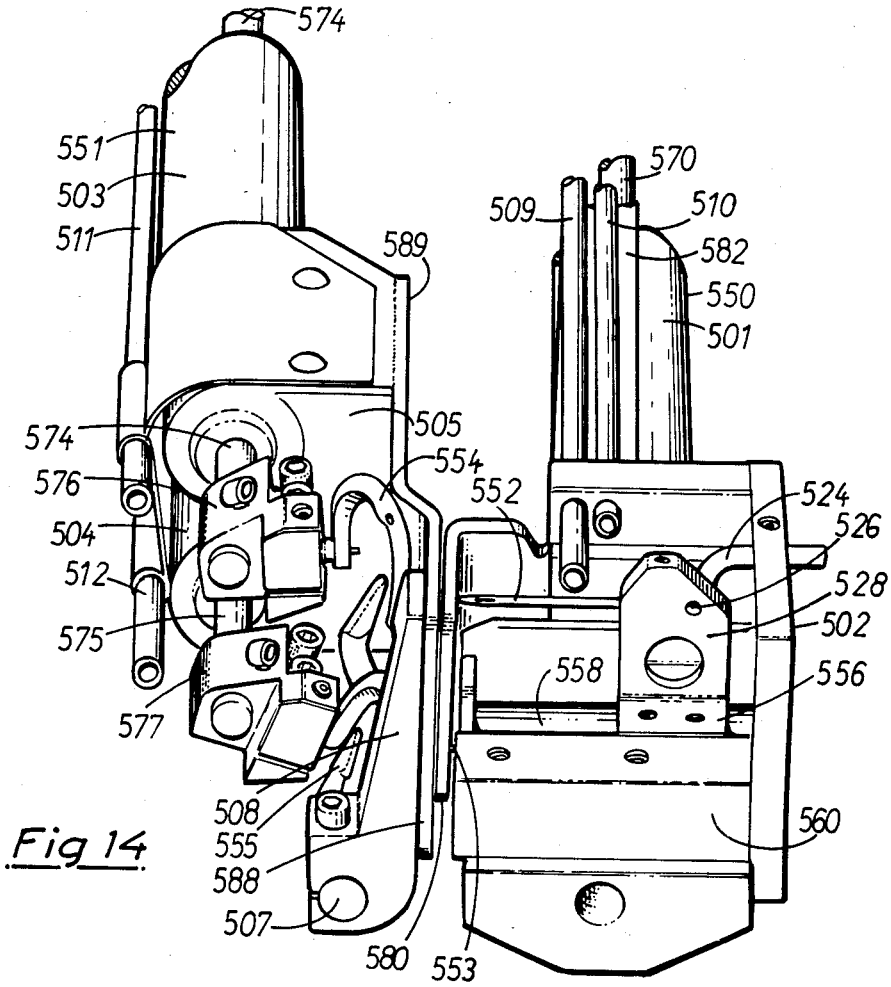
FIG. 14 is a front perspective view of the sewing instrumentalities of the sewing head of FIG. 13.

The sewing head 540 shown in Figs.13 and 14 can be modified to produce casings for the quilt shown in FIG. 1. To this end, the heads are arranged in two rows and are staggered, as shown in FIG. 2, but the lower needle 553, the lower looper 555, the lower looper drive shaft 575, the lower tube 504 and the thread guide tubes 510 and 512 are omitted in the case of the sewing heads of the upper row and the upper needle 552, the upper looper 554, the upper looper drive shaft 574, the upper tube 503 and the thread guide tubes 509 and 511 are omitted in the case of the sewing heads of the lower row.

I claim:

1. Sewing apparatus for sewing casings for forming into quilted articles comprising a plurality of sewing heads, each having a stitching zone and sewing instrumentalities at said zone for sewing a seam in a stitching direction; means supporting said sewing heads in at least one row which extends transversely to said stitching direction; and means for introducing two facings to the sewing heads from opposite sides of said row and for pleating the facings, said introducing means including guide means for guiding said pleats respectively from each of said facings into said stitching zones, whereby seams are formed in said pleats by said sewing instrumentalities and said pleats of the respective facings are sewn to one another.

2. Sewing apparatus for sewing casings for forming into quilted articles comprising a plurality of sewing heads, each having a stitching zone and sewing instrumentalities at said stitching zone for sewing a seam in a stitching direction; means supporting said sewing heads in two parallel rows which extend transversely to said stitching direction; means for introducing two facings respectively to the two rows of sewing heads from the sides thereof remote from one another and for pleating the facings, said introducing means including first guide means for guiding said pleats respectively into the stitching zones; and means for introducing divider strips to said sewing heads, the latter introducing means including second guide means for guiding one edge of each divider strip to a respective stitching zone of a sewing head of one row and the other edge of each divider strip to a respective stitching zone of a sewing head of the other row, whereby a seam is formed between each pleat and a respective edge of at least one divider strip.

3. Sewing apparatus according to claim 2, in which the sewing heads in one row are staggered with respect to those in the other row, and in which said second guide means for the edges of the divider strips are arranged to guide one edge of each of a respective pair of divider strips to the stitching zone of a respective one of the heads of one row and the other edge of each of two divider strips, one from each of two pairs, to the stitching zone of a respective one of the heads of the other row, whereby a seam is formed between each pleat and respective edges of two divider strips.

4. Sewing apparatus for sewing casing for forming into quilted articles, comprising a plurality of sewing heads, each having two stitching zones and sewing instrumentalities at each of said stitching zones for sewing two parallel seams in a stitching direction; means supporting said sewing heads in a row which extends transversely to said stitching direction with the two stitching zones of each head being spaced apart in a direction transverse to said row; means for introducing two facings to the sewing heads from opposite sides of said row and for pleating the facings, said introducing means including first guide means for guiding each pleat of one facing to a respective one of the stitching zones of each sewing head and each pleat of the other facing to the other stitching zone of each sewing head; and means for introducing a respective divider strip to each sewing head, the latter means including second guide means for guiding the opposite edges of each divider strip to the two stitching zones of the respective head, whereby a seam is formed between each pleat and a respective edge of the divider strip.

5. Sewing apparatus according to claim 1, in which each sewing head comprises first and second arms extending generally parallel to one another in the stitching direction, with proximal ends of said arms mounted on said support means and said stitching zones defined between distal ends of said arms, and in which said sewing instrumentalities comprise a needle mounted in the distal end of said first arm for movement transversely thereto through the stitching zone, a hole plate mounted on the distal end of said second arm so that the needle can enter a hole in said hole plate upon reciprocation of the needle, and a looper arranged in the distal end of said second arm behind the hole plate so as to co-operate with the needle thread.

6. Sewing apparatus according to claim 5, in which each sewing head incorporates a needle drive shaft extending longitudinally of said first arm from said proximal end thereof, a looper drive shaft extending longitudinally of said second arm from said proximal end thereof, and means coupling said needle drive shaft to said needle for reciprocating the latter, said looper being mounted to be driven by said looper drive shaft.

7. Sewing apparatus according to claim 5, in which said sewing instrumentalities further comprise a pressure foot, means pivotally mounting said presser foot on said first arm at a point remote from the distal end thereof so that the presser foot extends in the stitching direction into the stitching zone, and means biassing the presser foot towards the hole plate.

8. Sewing apparatus according to claim 1, in which said row of sewing heads is substantially horizontal and the stitching direction is also substantially horizontal.

9. Sewing apparatus according to claim 1, further comprising feed means for feeding the facings through the stitching zones, said feed means comprising means engaging the stitched facings beyond the stitching zones so as to pull the facings through the stitching zones, and intermittent drive means for the engaging means, said intermittent drive means being synchronized with drive means for the sewing instrumentalities.

* * * * *